US006089752A

United States Patent [19]

Moore

[11] Patent Number: 6,089,752

[45] Date of Patent: Jul. 18, 2000

[54] COMPRESSIBLE STUFF SACK

[76] Inventor: Michael Moore, 1415 NW. 52nd St., Seattle, Wash. 98107

[21] Appl. No.: 09/111,582

[22] Filed: Jul. 8, 1998

Related U.S. Application Data

[60] Provisional application No. 60/078,081, Mar. 16, 1998.

[51] Int. Cl.[7] ..... B65D 30/08; B65D 33/01; B65D 33/16

[52] U.S. Cl. ..... 383/2; 5/413 R; 383/80; 383/103

[58] Field of Search ..... 5/413 R; 383/80, 383/103, 2; 206/83.5

[56] References Cited

U.S. PATENT DOCUMENTS

| | | | |
|---|---|---|---|
| 61,467 | 1/1867 | Rose . | |
| 3,914,918 | 10/1975 | Laird | 206/83.5 |
| 3,998,304 | 12/1976 | Edgerton, Jr. et al. | 190/48 |
| 4,267,868 | 5/1981 | Lowe | 150/11 |
| 4,661,989 | 4/1987 | Risby | 383/2 |
| 5,125,547 | 6/1992 | Russell | 224/215 |
| 5,584,409 | 12/1996 | Chemberlen | 383/103 |
| 5,881,881 | 3/1999 | Carrington | 383/103 |

*Primary Examiner*—Stephen P. Garbe
*Attorney, Agent, or Firm*—Dean A. Craine

[57] ABSTRACT

A compressible stuff sack is disclosed, designed to be relatively easy to use and inexpensive to manufacture. The stuff sack includes a body made of flexible material with a main opening. A hands-free, one-way valve is provided on the sack which enables excess air to automatically escape from the sack when the sack is compressed. In one embodiment, the body is cylindrically-shaped and made of waterproof material. Attached to one end of the body is a bottom cap including an end plate with surrounding compression rings which are simultaneously welded over an opened end of the body. The opposite end of the body is opened and covered with a removable top cap. Four, spaced-apart compression straps are aligned longitudinally over the outside surface of the body and attached to the bottom and top caps. When the compression straps are shortened, the bottom and top caps are squeezed together to reduce the overall length of the sack and to compress the cargo.

5 Claims, 1 Drawing Sheet

COMPRESSIBLE STUFF SACK

This is a utility patent application based on a provisional patent application filed Mar. 16, 1998 (Ser. No. 60,078,081).

BACKGROUND OF THE INVENTION

1. Field of the Invention

This invention relates to stuff sacks, and more particularly, to such stuff sacks designed for carrying outdoor gear or sports equipment.

2. Description of the Related Art

It is common for hikers and campers to store their sleeping bags, clothing and other loose, lightweight items in duffel bags or stuff sacks. Usually when traveling, it is desirable to compress the stuff sack into a smaller shape to decrease its required storage space.

Because most stuff sacks are made of lightweight woven material with sewn seams, air slowly escapes through the woven material and the seams when the stuff sack is forcibly compressed. When the compressive force is removed, air reenters the stuff sack until it assumes its original shape. In order to quickly compress the stuff sack, the sack's main opening must be opened so that air may escape therethrough.

For outdoor sportsmen exposed to wet conditions, waterproof stuff sacks are desirable. One drawback with such stuff sacks is that the only method for removing air trapped inside the stuff sack is to open the main opening and then compress the sack.

For both woven and water-proof stuff sacks, air, of course, re-enters the sack as the main opening is being closed. Therefore, it is impossible to completely evacuate air from the sack. Also, the process of opening and closing the main opening and simultaneously compressing the sack is time consuming and requires the use of both hands.

Ideally, a stuff sack is needed which is easy to compress to completely remove trapped air.

SUMMARY OF THE INVENTION

It is an object of the present invention to provide a stuff sack that it easy and quick to compress to completely remove trapped air.

It is another object of the present invention to provide such a stuff sack that is made of waterproof material.

It is a further object of the present invention to provide such a stuff sack that is relatively inexpensive to manufacture.

These and other objects are met by providing a compressible stuff sack comprising a body made of flexible material. Formed on the body is at least one main opening enabling items to be easily inserted and removed from the sack. Attached to the sack is a one-way valve means which enables excess air to escape from the sack when the sack is compressed.

In one embodiment, the sack includes a cylindrical-shaped body made of waterproof material with a bottom cap heat-sealed over one end. The opposite end of the body is open thereby forming a main opening into the sack. Disposed over the main opening is a removable top cap. An optional compression means is provided between the top and bottom cap which enable the sack to be compressed along its longitudinal axis to reduce the sack's overall length. Also, an optional closing means is disposed around the top opening which enables the main opening to be selectively opened and closed. The one-way valve means is a hands-free, one-way valve capable of allowing air to automatically escape from the sack when the sack is compressed.

DESCRIPTION OF THE PREFERRED EMBODIMENT(S)

Figure 4:
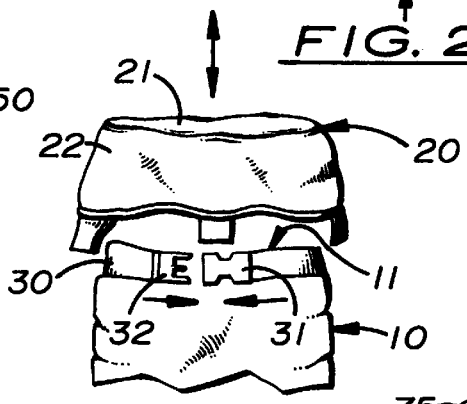
FIG. 4 is a side elevational view of the top cap being attached over the opening of the sack.
Figure 3:
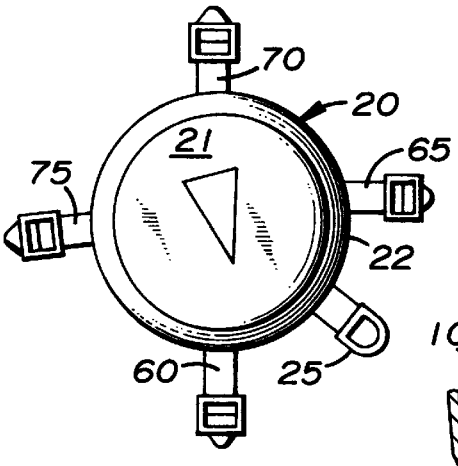
FIG. 3 is a top plan view of the top cap.
Figure 5:
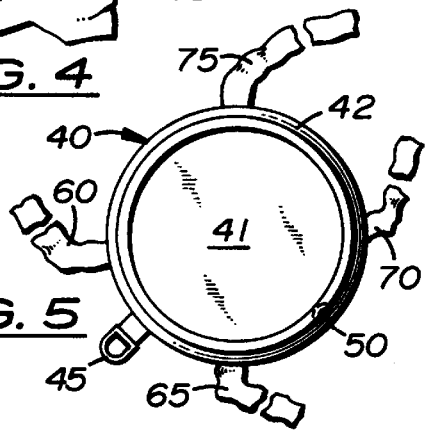
FIG. 5 is a bottom plan view of the bottom cap.

Referring to the accompanying FIGS. 1–6, wherein like numerals refer to like parts, there is shown a compressible stuff sack 5 designed to be relatively easy to use and inexpensive to manufacture. The stuff sack 5 includes a cylindrical-shaped body 10 with a bottom cap 40 securely attached over one end. The bottom cap 40 includes a circular end panel 41 and a surrounding compression ring 42 which are simultaneously welded to the distal edge of the body 10 to form a water-tight seal. The opposite end of the body 10 is open creating a main opening 11 which is covered with a removable top cap 20. The top cap 20 also includes a circular end panel 21 and a surrounding compression ring 22. As shown in FIG. 4, an optional cinching buckle 30 is attached around the open end of the body 10, which may be used to partially close the main opening 11. The cinching buckle 30 includes a female buckle 31 and a male buckle 32 spaced apart on opposite sides of the body 10. When the female buckle 31 and the male buckle 32 are interconnected, the main opening 11 in the body 10 is partially closed.

A plurality of spaced-apart, optional compression straps 60, 65, 70, 75, respectively, are aligned longitudinally over the outside surface of the body 10. In the preferred embodiment, four compression straps 60, 65, 70, 75 are used which are radially aligned at equal distances around the outer surface of the body 10. The opposite ends of the compression straps 60, 65, 70, 75, are attached to the top and bottom caps 20, 40, respectively. During use, the compression straps 60, 65, 70, 75 may be shortened so that the top and bottom caps 20, 40, are pulled together to reduce the overall length of the stuff sack 5 and to compress cargo located inside.

A one-way valve means is provided on the side of the body 10 to allow air to escape from the sack 5 when the sack 5 is compressed. In the preferred embodiment, the one-way valve means is a hands-free, one-way valve 50 designed to allow air to automatically escape when the air pressure inside the sack 5 exceeds the air pressure outside the sack 5. By using a hands-free, one-way valve 50, the user does not need to use his or her hands to manipulate the valve 50 to remove air from the sack 5. Instead, the user can easily remove air from the sack 5 by shortening the compression straps 60, 65 70, 75 to squeeze the caps 20, 40 or using both hands to force the sides of the sack 5 inward. In the embodiment shown in the Figs., the hands-free, one-way valve 50 is located under the compression ring 42 to protect it during use.

Figure 1:
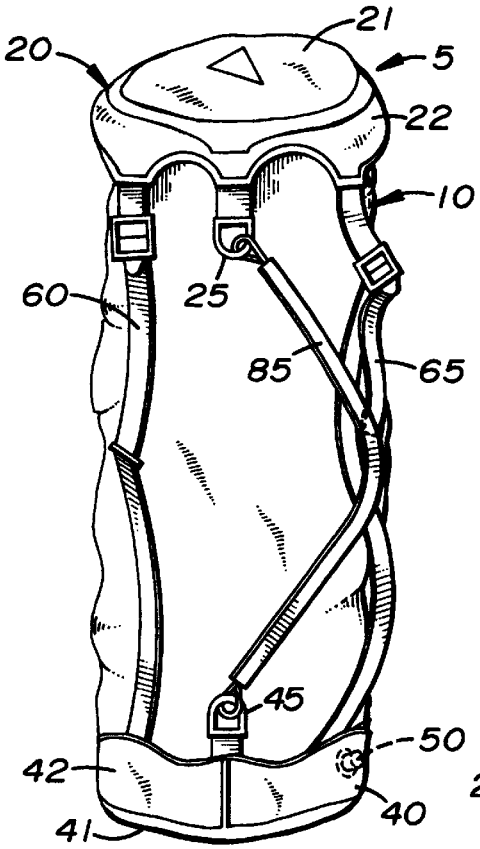
FIG. 1 is a side perspective view of the stuff sack disclosed herein in an uncompressed state.
Figure 2:
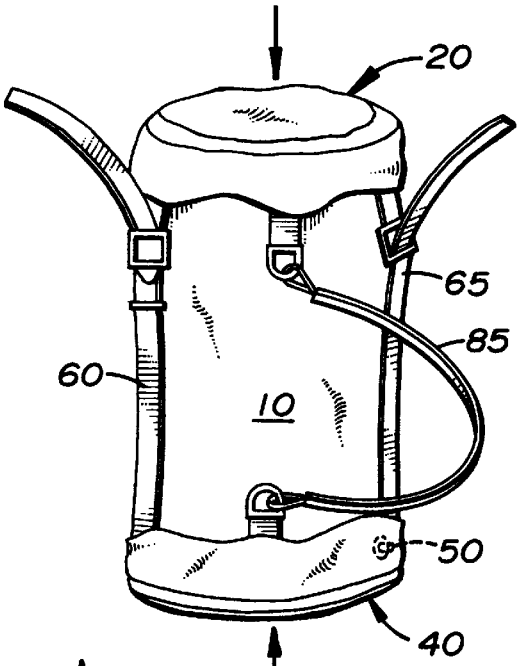
FIG. 2 is a side perspective view of the invention shown in FIG. 1 in a compressed state.

Also, as shown in FIG. 1, an optional detachable handle 85 is attached at its opposite ends to a pair of D-rings 25, 45 attached to the top cap 20 and the bottom cap 40, respectively.

In one embodiment, the body 10, bottom cap 40, and compression rings 22, 42 are made of durable, waterproof material, capable of being radio-frequency welded together.

The waterproof material is made of 500 denier weight nylon material with an inner layer made of urethane material approximately 0.003 thick, and an outer kiss coat of urethane. It should be understood that the weight of the middle nylon material may be between 50 to 1800 denier. The end panels 21, 41 and compression rings 22, 42 of the top and bottom caps 20, 40, respectively, are made of vinyl or nylon having a weight between 50 to 1800 denier. The end panels 21, 41, and compression rings 22, 42, can also be made of nylon or vinyl coated urethane material similar to the material used to manufacture body 10.

Figure 6:
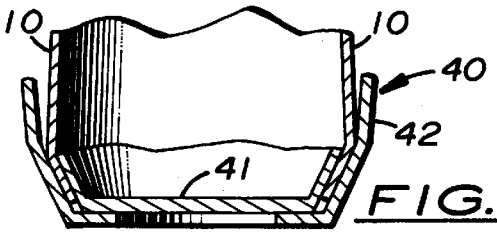
FIG. 6 is a sectional side elevational view of the bottom cap attached to the body.

As shown in FIG. 6, during manufacturing the outer edge of the end panel 41 on the bottom cap 40 and the inside edge of the compression ring 42 are simultaneously radio-frequency welded to the distal edge of the body 10. The outer edge of the panel 41 and distal end of the body 10 are registered, aligned, and simultaneously welded together in one step, thereby reducing manufacturing costs.

It should be understood, however, that the stuff sack 5 may be made of woven material, such as canvas, with sewn seams.

In compliance with the statute, the invention, described herein, has been described in language more or less specific as to structural features. It should be understood, however, the invention is not limited to the specific features shown, since the means and construction shown comprise only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. A compressible stuff sack, comprising:

a. a body made of water-proof material;

b. a main opening formed in said body enabling items to be inserted or removed therefrom;

c. a hands-free, one-way valve attached to said body, said one-way valve being oriented on said body so that air can escape from said body when said body is compressed;

d. a closing means for selectively opening and closing said main opening; and, e. a compression strap attached at its opposite ends to said body and capable of being shortened to reduce the overall length of slid body and force air outward through said one-way valve.

2. A compressible stuff sack, comprising:

a. a cylindrical-shaped body made of water-proof material, said body having a main opening formed therein;

b. a bottom cap securely attached to said body;

c. a top cap capable of being selectively attached over said main opening of said body;

d. a hands-free, one-way valve attached to said body, said one-way valve being oriented on said body to allow air to escape from said body when said body is compressed;

e. at least one compression strap attached between said bottom cap and said top cap, said compression strap capable of being adjusted in length to force said bottom cap and said top cap together thereby compressing said body and forcing air outward through said one-way valve.

3. A compressible stuff sack, as recited in claim 2, wherein said bottom cap and said top cap each comprise an end plate and a compression ring radio-frequency welded together.

4. A compressible stuff sack, as recited in claim 2, further including a detachable handle.

5. A compressible stuff sack, as recited in claim 2, further including a closing means for selectively closing and opening said main opening.

* * * * *